US012796786B2

(12) United States Patent
Chen et al.

(10) Patent No.: US 12,796,786 B2
(45) Date of Patent: Nov. 17, 2026

(54) EXTENSIBLE LOCK PULL AND SLIDER

(71) Applicant: YKK Corporation, Tokyo (JP)

(72) Inventors: Lifeng Chen, Shanghai (CN); Chin Wen Yen, Taipei (TW); Wei Chen Yeh, Taipei (TW); Hua Wang, Shanghai (CN)

(73) Assignee: YKK Corporation, Tokyo (JP)

( * ) Notice: Subject to any disclaimer, the term of this patent is extended or adjusted under 35 U.S.C. 154(b) by 36 days.

(21) Appl. No.: 18/984,663

(22) Filed: Dec. 17, 2024

(65) Prior Publication Data

US 2025/0204652 A1 Jun. 26, 2025

(30) Foreign Application Priority Data

Dec. 20, 2023 (CN) ..... 202311764268.8

(51) Int. Cl.

| | |
|---|---|
| ***A44B 19/30*** | (2006.01) |
| *A44B 19/26* | (2006.01) |
| *A45C 13/18* | (2006.01) |

(52) U.S. Cl.

CPC ..... *A44B 19/305* (2013.01); *A44B 19/262* (2013.01); *A45C 13/18* (2013.01); *Y10T 24/2586* (2015.01)

(58) Field of Classification Search

CPC . A44B 19/262; A44B 19/301; Y10T 24/2589; Y10T 24/2568; Y10T 24/1379; Y10T 24/4522; Y10T 70/8676; Y10T 70/5053; A44C 13/103; F16B 21/09

USPC ..... 190/101, 103, 120, 121; 383/42; 70/57

See application file for complete search history.

(56) References Cited

U.S. PATENT DOCUMENTS

| | | | | |
|---|---|---|---|---|
| 2,253,494 | A * | 8/1941 | Carlile | A44B 19/262 24/429 |
| 5,090,096 | A | 2/1992 | Terada et al. | |
| D820,727 | S * | 6/2018 | Zhang | D11/221 |
| 2003/0066170 | A1* | 4/2003 | Huang | A44B 19/301 24/387 |
| 2014/0069757 | A1* | 3/2014 | Schlipper | A44B 19/301 24/386 |
| 2017/0135446 | A1* | 5/2017 | Behrend | A44B 19/262 |

(Continued)

FOREIGN PATENT DOCUMENTS

| | | | | |
|---|---|---|---|---|
| CN | 214854784 U | 11/2021 | | |
| EP | 2926679 A1 * | 10/2015 | | A45C 13/18 |
| JP | H07-027849 Y2 | 6/1995 | | |

*Primary Examiner* — Jason W San
*Assistant Examiner* — Michael S Lee
(74) *Attorney, Agent, or Firm* — Kilpatrick Townsend & Stockton LLP

(57) ABSTRACT

An extensible lock pull includes: a pull main body including, at one end thereof, a slider connecting portion; a lock head; and a position limiting buffer member. The pull main body is provided with a sliding groove extending along a length direction thereof. The lock head is movably connected to the sliding groove along an extending direction of the sliding groove. The pull main body is provided with an attachment opening portion in communication with the sliding groove at an end of the sliding groove. The lock head is connected to the sliding groove through the attachment opening portion. The position limiting buffer member is fixed to the pull main body and blocks the attachment opening portion. The pull main body and the lock head are both metal parts. The position limiting buffer member is a plastic part or a rubber part.

13 Claims, 10 Drawing Sheets

(56) References Cited

U.S. PATENT DOCUMENTS

| | | | | |
|---|---|---|---|---|
| 2020/0229551 | A1* | 7/2020 | Detry | A45C 13/103 |
| 2026/0182709 | A1* | 7/2026 | Zheng | A44B 19/262 |

* cited by examiner

EXTENSIBLE LOCK PULL AND SLIDER

CROSS-REFERENCE TO RELATED APPLICATIONS

This application is based on and claims priority under 35 USC § 119 from Chinese Patent application Ser. No. 20/231, 1764268.8 filed on Dec. 20, 2023, the contents of which are incorporated herein by reference.

TECHNICAL FIELD

The present invention relates to the technical field of slide fasteners, in particular to an extensible lock pull and a slider including the extensible lock pull.

BACKGROUND

At present, most suitcases are equipped with a combination lock and a slide fastener for opening and closing a suitcase. A lock head is fixed on a pull of the slide fastener. The suitcase is locked through the matched connection of the lock head and the combination lock, and the safety of the suitcase in use is improved.

Further, some suitcases also have an expansion function. When fewer items are placed in a suitcase, the expansion function does not need to be used. At this time, a vertical distance between a slider main body of the slide fastener for opening and closing the suitcase and the combination lock is set as a first distance. When more items need to be placed in the suitcase, the expansion function needs to be used to expand an internal storage space of the suitcase. At this time, the vertical distance between the slider main body of the slide fastener for opening and closing the suitcase and the combination lock is set as a second distance. Generally, the first distance of the suitcase in a non-expansion state is smaller than the second distance of the suitcase in an expansion state, which requires that a position of the lock head in a length direction of the pull is variable so as to simultaneously satisfy the connection between the lock head and the combination lock in the first distance and the second distance. However, in slide fasteners in the related art, the lock head is usually integrally formed at an outer end of the pull, and thus the position of the lock head in the length direction of the pull is uniquely determined. As a result, the lock head cannot be well used in the above suitcases with the expansion function.

In addition, after the suitcase is sewn with the slide fastener, an actual sewing position of the slide fastener may deviate from an ideal position. For slide fasteners with a lock head whose position cannot be changed, there is a problem that the lock head cannot be inserted into the combination lock well during subsequent use.

SUMMARY

The present invention provides an extensible lock pull, including: a pull main body including: at one end thereof, a slider connecting portion; a lock head; and a position limiting buffer member, in which the pull main body is provided with a sliding groove extending in a length direction thereof, the lock head is movably connected to the sliding groove in an extending direction of the sliding groove, the pull main body is provided with an attachment opening portion in communication with the sliding groove at an end of the sliding groove, the lock head is connected to the sliding groove through the attachment opening portion, the position limiting buffer member is fixed to the pull main body and blocks the attachment opening portion, the pull main body and the lock head are both metal parts, and the position limiting buffer member is a plastic part or a rubber part.

The extensible lock pull further includes the sliding link, which is movably assembled in the sliding groove along the extending direction of the sliding groove. The lock head is integrally formed at one end of the sliding link and located outside the pull main body. Another end of the sliding link is attached to the sliding groove through the attachment opening portion, and the sliding link is a metal part.

Along a width direction of the pull main body, a width of the sliding groove is smaller than a width of the attachment opening portion, and thus the pull main body includes sliding support portions on both sides in a width direction of the sliding groove. The sliding link includes a link main body portion, a connecting column portion, and a position limiting blade portion. The lock head is integrally formed at one end of the link main body portion. The connecting column portion and the position limiting blade portion are integrally formed at another end of the link main body portion in sequence in a thickness direction of the pull main body. The attachment opening portion allows the connecting column portion and the position limiting blade portion to pass therethrough. The connecting column portion is movably accommodated in the sliding groove. The link main body portion and the position limiting blade portion are provided to clamp each of the sliding support portions from two sides thereof in the thickness direction of the pull main body.

The connecting column portion and the sliding groove are in clearance fit.

A surface of the pull main body is provided with a guide groove parallel to the sliding groove, and the link main body portion is slidably accommodated in the guide groove.

The lock head is assembled in the sliding groove.

Along a width direction of the pull main body, a width of the sliding groove is smaller than a width of the attachment opening portion, and thus the pull main body includes sliding support portions on both sides in a width direction of the sliding groove. The lock head includes a lock head main body portion and a lock head connecting portion which are connected in sequence. The attachment opening portion allows at least one of the lock head main body portion or the lock head connecting portion to pass therethrough. The lock head connecting portion is provided with a connecting clamping groove parallel to the sliding groove. Each of the sliding support portions is clamped in the connecting clamping groove.

The attachment opening portion is provided at one end of the sliding groove close to the slider connecting portion.

The position limiting buffer member is fixed on the pull main body by injection molding. In addition, the pull main body is provided with a reinforcement connecting hole, and the reinforcement connecting hole is located on a side of the attachment opening portion opposite to the sliding groove. A part of the position limiting buffer member is embedded in the reinforcement connecting hole.

The position limiting buffer member is clamped on the pull main body. The position limiting buffer member includes a cover plate portion, side wall portions extending from two sides of the cover plate portion in a thickness direction of the pull main body, and anti-separation claws each extending from an inner side of a corresponding one of the side wall portions. The cover plate portion covers a surface of the pull main body, the side wall portions cover side surfaces of the pull main body, and the anti-separation claws are clamped on a back surface of the pull main body.

A surface of the position limiting buffer member is provided with a logo.

The present application further provides a slider, including a slider main body and the above extensible lock pull, in which the slider connecting portion of the pull main body is connected to the slider main body.

DESCRIPTION OF EMBODIMENTS

Figure 1:
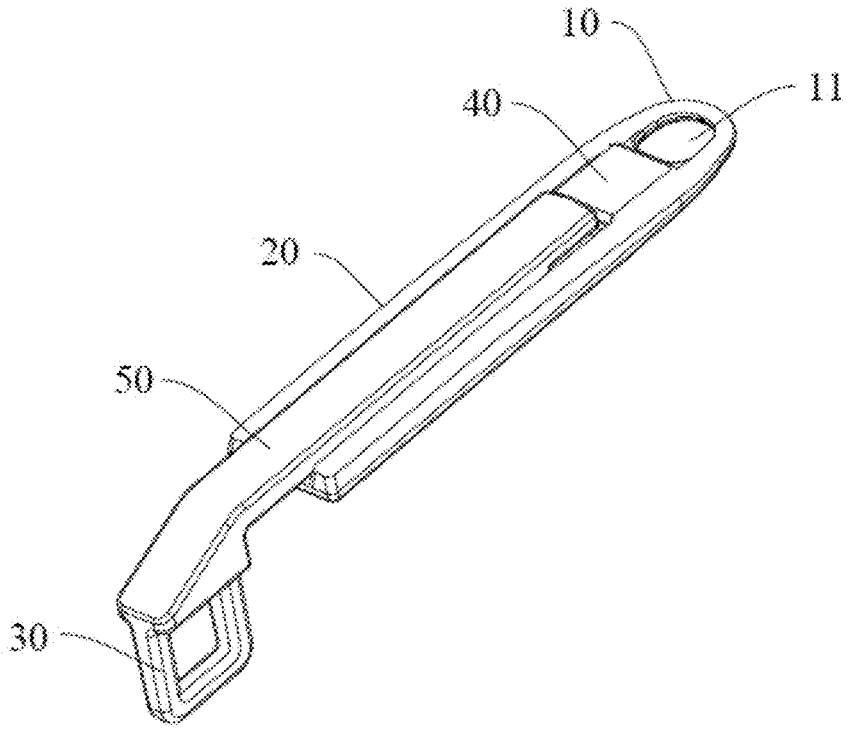
FIG. 1 is a schematic structural diagram of an extensible lock pull of a first embodiment in the present application.

Embodiments of the present invention will be described below with specific embodiments. Those skilled in the art could easily understand other advantages and effects of the present invention from contents disclosed in the present description.

It should be noted that structures, proportions, sizes, and the like shown in the drawings of the present description are merely for the understanding and reading of those skilled in the art, in combination with the contents disclosed in the present description, and are not used to limit the conditions under which the present invention can be implemented, and therefore have no technical substantive significance. Any structural modifications, changes in proportions, or size adjustments should still fall within the scope of the technical content disclosed in the present invention, as long as they do not affect the effects and objects of the present invention. Meanwhile, terms such as "upper", "lower", "left", "right", "intermediate" and "one" referred to in the present description are merely for the convenience of description and are not used to limit the scope within which the present invention can be implemented, and changes or adjustments of relative relations are also considered to be within the scope within which the present invention can be implemented, as long as there is no substantial technical change.

It should also be noted that when an element is referred to as being "fixed to" or "disposed on" another element, the element may be directly fixed to the other element or may be directly disposed on the other element, or there may be an intermediate element at the same time. When an element is referred to as being "connected" to another element, the element may be directly connected to the other element or may be indirectly connected to the other element through an intermediate element.

In addition, descriptions related to "first", "second", and the like in the present application are merely used for description and cannot be understood as indicating or implying relative importance or implicitly indicating the number of indicated technical features. Therefore, features defined with "first" and "second" may explicitly or implicitly include at least one of these features. In addition, technical solutions in various embodiments may be combined, but only if those skilled in the art can implement these embodiments. When the combination of the technical solutions appears to be contradictory or cannot be implemented, it should be considered that the combination of the technical solutions does not exist and is not within the protection scope claimed by the present application.

Figure 16:
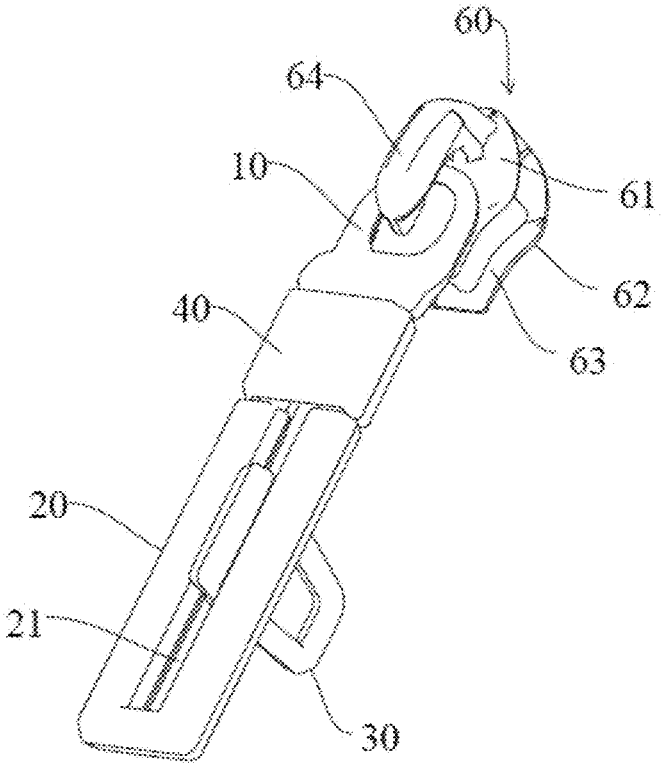
FIG. 16 is a schematic structural diagram of a slider provided with the extensible lock pull of the second embodiment in the present application.

The present application relates to the technical field of slide fasteners, in particular to a slider for a slide fastener. As shown in FIG. 16, the slider includes a slider main body 60 and an extensible lock pull, and one end of the extensible lock pull is attached to a surface of the slider main body 60. For convenience of description, in the following embodiments, directions are defined as follows. A length direction of the extensible lock pull is defined as a front-rear direction, a width direction of the extensible lock pull is defined as a left-right direction, and a thickness direction of the extensible lock pull is defined as an up-down direction. Based on this, in the views shown in FIGS. 3 and 9, an upper side and a lower side of the paper are a front direction and a rear direction, respectively, a left side and a right side of the paper are a left direction and a right direction, respectively, and a front side and a back side of the paper are an upper direction and a lower direction, respectively. In addition, a length direction, a width direction, and a thickness direction of the slider are consistent with the length direction, the width direction, and the thickness direction of the extensible lock pull, respectively.

As shown in FIG. 16, the slider main body 60 includes an upper blade 61 and a lower blade 62 connected up and down in a thickness direction thereof, an element path 63 formed between the upper blade 61 and the lower blade 62, and a pull connecting portion 64 fixed to an upper surface of the upper blade 61. The pull connecting portion 64 is connected to the extensible lock pull.

Figure 2:
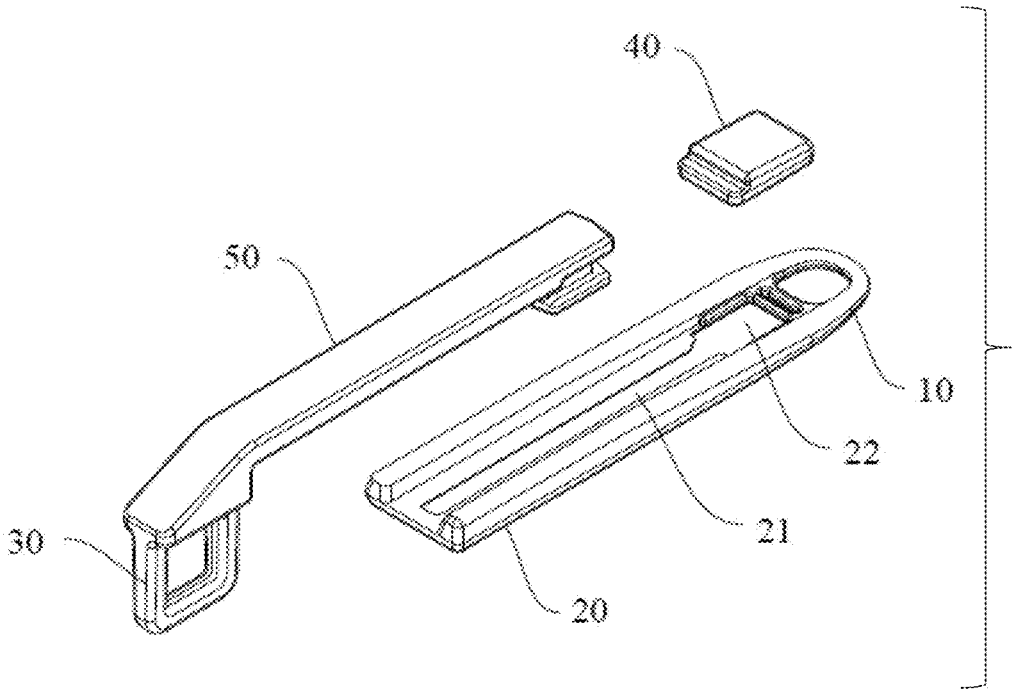
FIG. 2 is an exploded view of FIG. 1.
Figure 3:
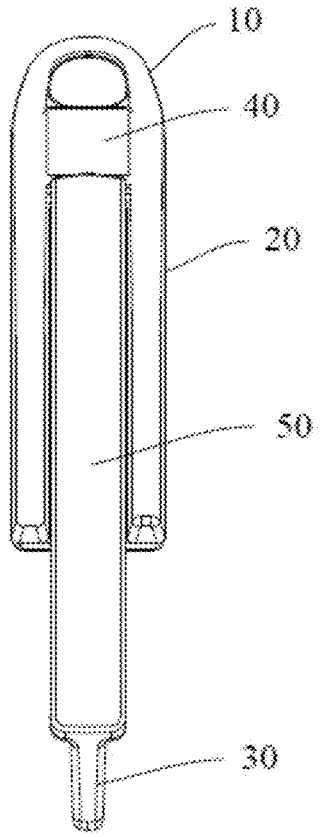
FIG. 3 is a top view of FIG. 1.
Figure 7:
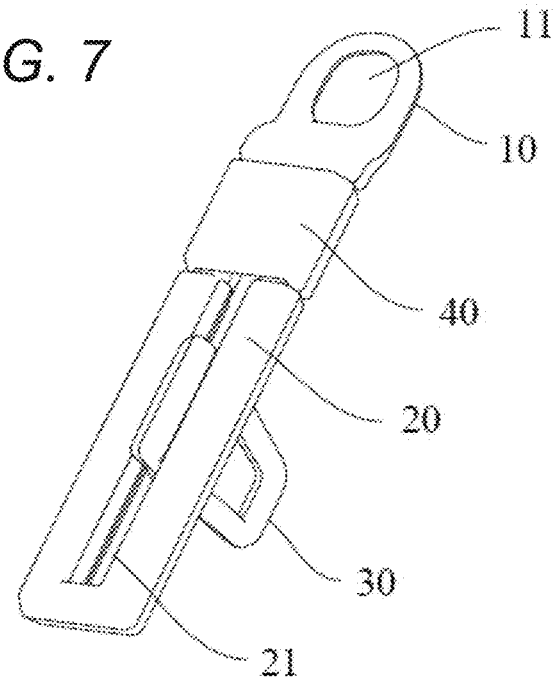
FIG. 7 is a schematic structural diagram of an extensible lock pull of a second embodiment in the present application.
Figure 8:
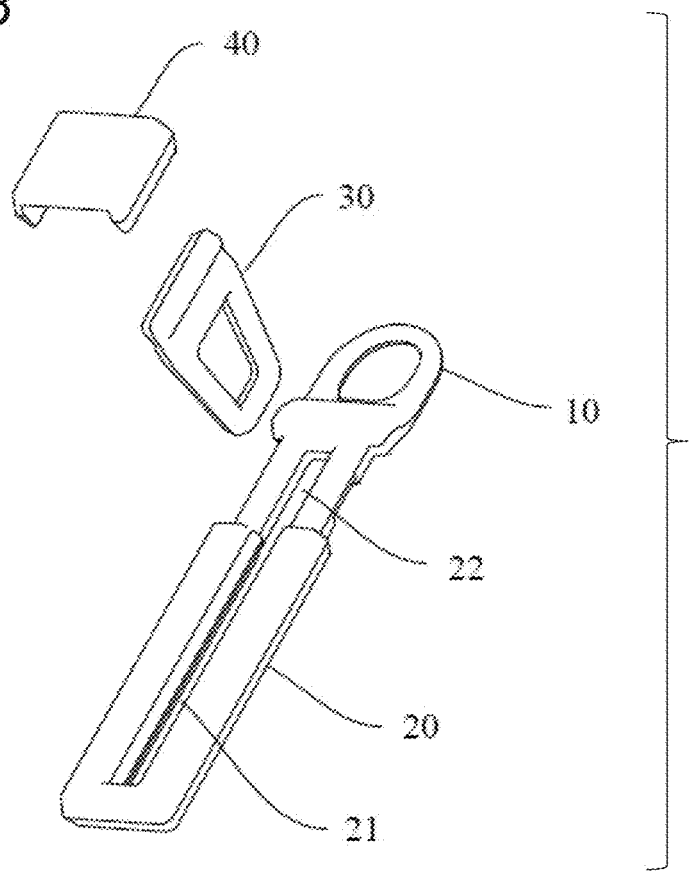
FIG. 8 is an exploded view of FIG. 7.
Figure 9:
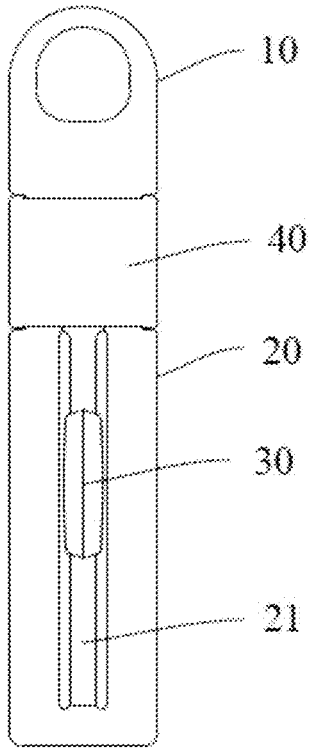
FIG. 9 is a top view of FIG. 7.

As shown in FIGS. 1 to 3, or as shown in FIGS. 7 to 9, an extensible lock pull according to the present application includes a pull main body 20, a lock head 30, and a position limiting buffer member 40. A front end of the pull main body 20 is provided with a slider connecting portion 10, the slider connecting portion 10 has an annular structure with an attachment connecting hole 11 in the intermediate portion.

The pull main body 20 is provided with a sliding groove 21 extending forward and backward along a length direction thereof, the lock head 30 is connected to the sliding groove 21 in a manner of being movable forward and backward along an extending direction of the sliding groove 21, and the lock head 30 is used to be connected to a combination lock on a suitcase to play a locking role. At least one of two ends of the pull main body 20 in a length direction of the sliding groove 21 is provided with an attachment opening portion 22, the attachment opening portion 22 is in communication with the sliding groove 21, and the lock head 30 is connected to the sliding groove 21 through the attachment opening portion 22. After the lock head 30 is attached, the position limiting buffer member 40 is fixed to the pull main body 20 and blocks the attachment opening portion 22. Both the pull main body 20 and the lock head 30 are metal parts, and the position limiting buffer member 40 is a plastic part or a rubber part. The position limiting buffer member 40 may be made of hard plastic, soft plastic, rubber, and other materials, and accordingly, the position limiting buffer member 40 may be a hard plastic part, a soft plastic part, or a rubber part.

When the extensible lock pull is connected to the slider main body 60, the slider connecting portion 10 at the front end of the pull main body 20 is fitted into the pull connecting portion 64 of the slider main body 60 through the attachment connecting hole 11 thereof, and thus the pull main body 20 is connected to the slider main body 60. By holding the extensible lock pull, the slider can be conveniently pulled forward and backward along a length direction of a slide fastener, thereby closing or opening the slide fastener.

In the above extensible lock pull, the lock head 30 is connected to the sliding groove 21 in a manner of being movable forward and backward along the extending direction of the sliding groove 21, and thus a front-rear position of the lock head 30 in the extending direction of the sliding groove 21 is variable, that is, a front-rear position of the lock head 30 in the length direction of the extensible lock pull is variable, which makes the lock head 30 have an extensible structure in the front-rear direction. In this way, when a slide fastener provided with the extensible lock pull is used for opening and closing a suitcase with an expansion function, a distance between the lock head 30 and the slider main body 60 can be changed by moving the lock head 30 forward and backward. Taking the view angle of FIG. 3 or FIG. 9 as an example, when the suitcase does not need the expansion function, the lock head 30 is moved forward in a direction close to the slider main body 60, and the distance between the lock head 30 and the slider main body 60 is shortened, which is suitable for connecting the lock head 30 with a combination lock on the suitcase in a non-expansion state of the suitcase. When the suitcase needs the expansion function, the lock head 30 is moved backward in a direction away from the slider main body 60, and the distance between the lock head 30 and the slider main body 60 is increased, which is suitable for connecting the lock head 30 with the combination lock on the suitcase in an expansion state of the suitcase. Therefore, in the present application, by moving the lock head 30 forward and backward with respect to the pull main body 20, the lock head 30 can be well connected to the combination lock on the suitcase in both the non-expansion state and the expansion state of the suitcase, thereby improving the convenience of use and meeting the requirement of the suitcase with the expansion function for the variable position of the lock head 30 in the slide fastener, or meeting the requirement of the suitcase with the expansion function for the variable distance between the lock head 30 and the slider main body 60 in the slide fastener. Moreover, regardless of whether a suitcase has the expansion function, when a slide fastener provided with the extensible lock pull is used for opening and closing the suitcase, the position of the lock head 30 can be changed forward and backward, which can well offset a deviation of an actual sewing position of the slide fastener, allowing a larger deviation of the actual sewing position of the slide fastener, ensuring that the lock head 30 can be well connected to a combination lock on the suitcase, thereby improving the convenience and safety of use.

Further, in the above extensible lock pull, by providing the attachment opening portion 22 on the pull main body 20, the lock head 30 can be conveniently connected to the sliding groove 21. After the lock head 30 is attached, the position limiting buffer member 40 is provided to block the attachment opening portion 22 so as to prevent the lock head 30 from being separated from the sliding groove 21, thereby reliably maintaining the slidable connection between the lock head 30 and the sliding groove 21. In subsequent use, when the lock head 30 slides forward and backward with respect to the sliding groove 21, a sliding part in the sliding groove 21 abuts against the position limiting buffer member 40 when sliding to the attachment opening portion 22. The position limiting buffer member 40 is a plastic part or a rubber part, which is a soft member with certain elasticity, thereby playing a good buffering role. The pull main body 20 and the lock head 30 are both metal parts, and thus the pull main body 20 and the lock head 30 both have good own structural strength and wear resistance, thereby improving the overall structural strength and wear resistance of the extensible lock pull, making the extensible lock pull durable.

Further, in the above extensible lock pull, the lock head 30 may be directly connected to the sliding groove 21, and the lock head 30 may also be indirectly connected to the sliding groove 21 through other components. The position limiting buffer member 40 may be directly injection-molded on the pull main body 20, or may be injection-molded first and then fixed to the pull main body 20. Based on different connection structures between the lock head 30 and the sliding groove 21 and different fixing structures between the position limiting buffer member 40 and the pull main body 20, the extensible lock pull has a plurality of embodiments. The following provides three preferred embodiments of the extensible lock pull.

Extensible Lock Pull of First Embodiment

As shown in FIGS. 1 to 3, in an extensible lock pull of a first embodiment, the lock head 30 is indirectly connected to the sliding groove 21 through a sliding link 50. Thus, in addition to the pull main body 20, the lock head 30, and the position limiting buffer member 40, the extensible lock pull of the first embodiment further includes the sliding link 50. The sliding link 50 is assembled in the sliding groove 21 in a manner of being movable forward and backward along an extending direction of the sliding groove 21. The lock head 30 is integrally formed at a rear end of the sliding link 50. The lock head 30 is located outside the pull main body 20, that is, the lock head 30 is an external structure with respect to the pull main body 20 and the sliding groove 21. A front end of the sliding link 50 is attached to the sliding groove 21 through the attachment opening portion 22, and the sliding link 50 is a metal part.

In the extensible lock pull of the first embodiment, the sliding link 50 is directly assembled in the sliding groove 21, and the lock head 30 is integrally formed at the rear end of the sliding link 50. Therefore, the lock head 30 slides forward and backward with respect to the sliding groove 21 so that the lock head 30 can extend backward and retract forward with respect to the pull main body 20, and the lock head 30 can be disposed outside the pull main body 20 and the sliding groove 21. When the lock head 30 adopts an external structure, on the one hand, a position of the lock head 30 in a required front-rear range can be changed by using a shorter pull main body 20 and the sliding link 50, and a length of the pull main body 20 is relatively shortened without lengthening the pull main body 20. On the other hand, the connection between the lock head 30 and the combination lock is performed outside the pull main body 20, the pull main body 20 does not interfere with the locking of the lock head 30, which facilitates the locking operation of the lock head 30. Meanwhile, the sliding link 50 and the lock head 30 are an integrally formed structure, which are a one-piece metal part with high product structural strength, wear resistance, and durability.

Figure 4:
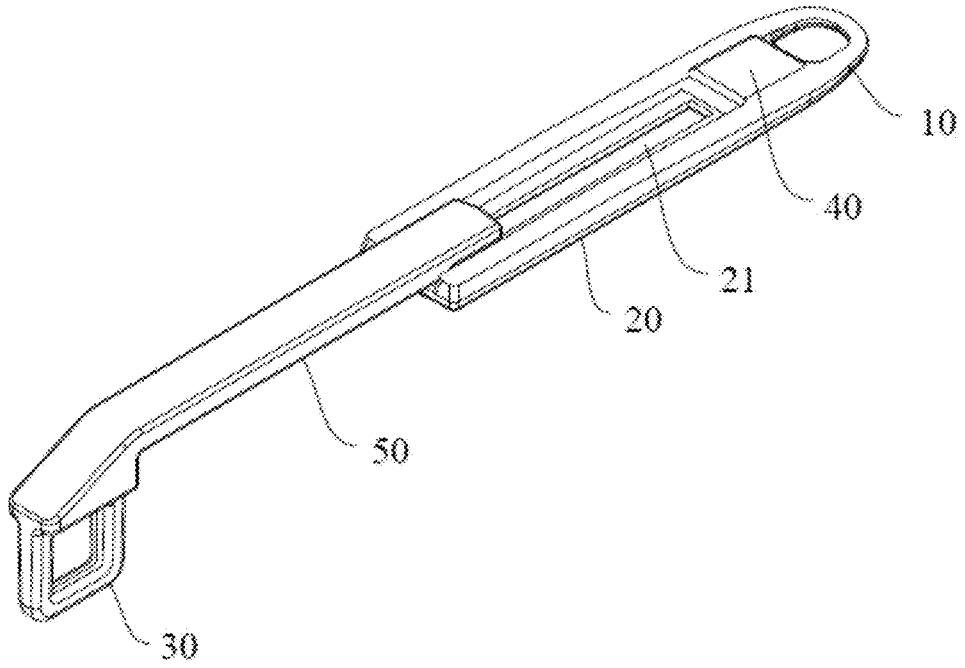
FIG. 4 is a schematic diagram showing a state in which a sliding link in FIG. 1 is extended rearward to the maximum extent.
Figure 6:
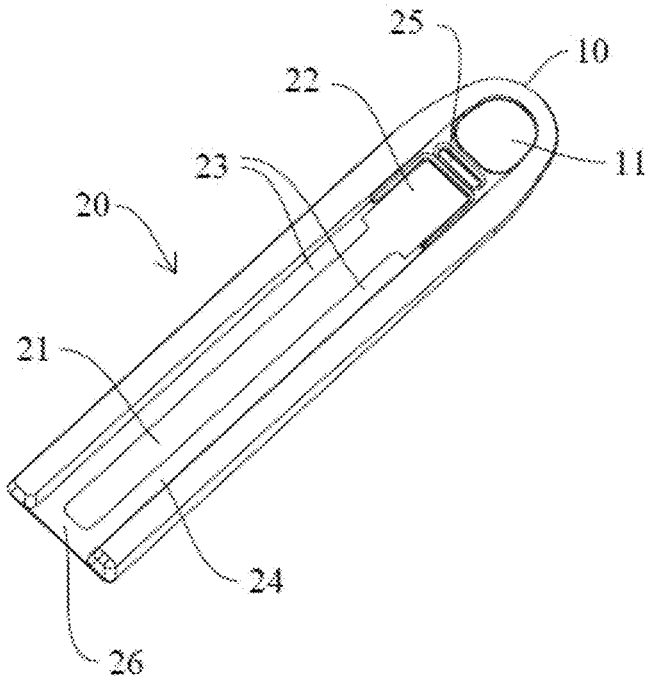
FIG. 6 is a schematic structural diagram of a pull main body in FIG. 1.

Further, the attachment opening portion 22 may be provided at a front end and a rear end of the sliding groove 21, or may be provided only at the front end or the rear end of the sliding groove 21. In the extensible lock pull of the first embodiment, as shown in FIG. 6, the pull main body 20 is provided with the attachment opening portion 22 only at the front end of the sliding groove 21 close to the slider connecting portion 10, the pull main body 20 is provided with a blocking end 26 at the rear end of the sliding groove 21, and the front end and the rear end of the sliding groove 21 are blocked by the position limiting buffer member 40 and the blocking end 26, respectively. In a case where the sliding link 50 slides forward and backward in the sliding groove 21 to enable the lock head 30 to extend and retract with respect to the pull main body 20, when the sliding link 50 slides forward to the front end of the sliding groove 21 and abuts against the position limiting buffer member 40, as shown in FIG. 1, the position limiting buffer member 40 can not only play a buffering role, but also limit the further forward movement of the sliding link 50. At this time, a minimum distance exists between the lock head 30 and the slider main body 60. When the sliding link 50 slides backward to the rear end of the sliding groove 21 and abuts against the blocking end 26, as shown in FIG. 4, the blocking end 26 limits the further backward movement of the sliding link 50. At this time, a maximum distance exists between the lock head 30 and the slider main body 60.

Figure 5:
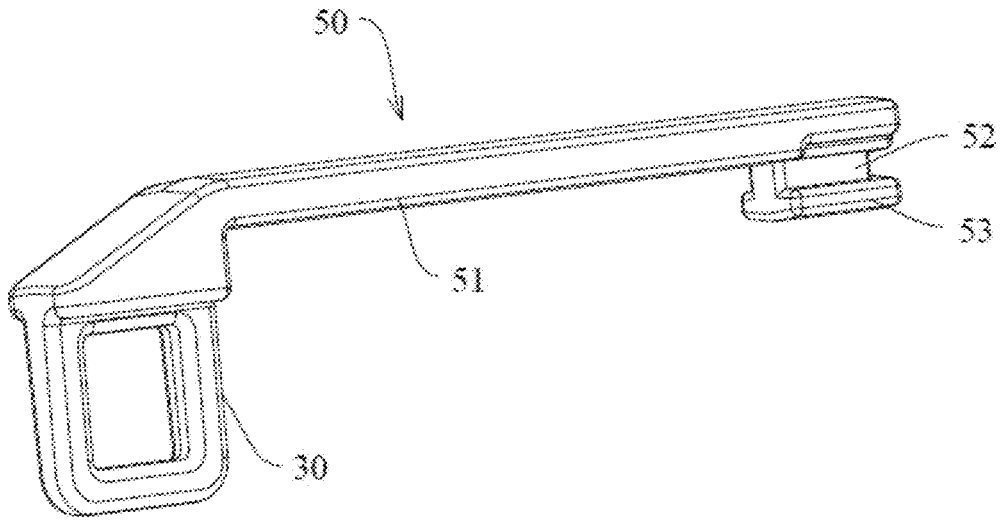
FIG. 5 is a schematic structural diagram of the sliding link and a lock head in FIG. 1.

Further, a preferred structure of the sliding link 50 being attached to the sliding groove 21 through the attachment opening portion 22 is as follows. As shown in FIG. 6, in the left-right direction, a width of the sliding groove 21 is smaller than a width of the attachment opening portion 22, and thus the pull main body 20 includes sliding support portions 23 on both left and right sides in a width direction of the sliding groove 21. As shown in FIG. 5, the sliding link 50 includes a link main body portion 51, a connecting column portion 52, and a position limiting blade portion 53. The link main body portion 51 extends forward and backward, the lock head 30 is integrally formed at a rear end of the link main body portion 51, the connecting column portion 52 is integrally formed at a front end of the link main body portion 51 and extends up and down along a thickness direction of the pull main body 20, and the position limiting blade portion 53 is integrally formed at a lower end of the connecting column portion 52 along the thickness direction of the pull main body 20. The attachment opening portion 22 allows the connecting column portion 52 and the position limiting blade portion 53 to pass therethrough. When the sliding link 50 is attached, the position limiting blade portion 53 and the connecting column portion 52 at the front end of the sliding link 50 are first inserted into the attachment opening portion 22 in sequence. Then, the sliding link 50 is moved backward, and thus the connecting column portion 52 is accommodated in the sliding groove 21. Finally, the position limiting buffer member 40 is attached at the attachment opening portion 22, thereby completing the attachment of the sliding link 50 having the lock head 30 at the rear end thereof. After the attachment is completed, the connecting column portion 52 is accommodated in the sliding groove 21 in a manner of being movable forward and backward, and the link main body portion 51 and the position limiting blade portion 53 are respectively clamped on an upper side and a lower side of the sliding support portion 23 in the thickness direction of the pull main body 20, and thus the sliding link 50 is reliably held in the sliding groove 21.

Preferably, the connecting column portion 52 and the sliding groove 21 are in clearance fit, which can not only enable the sliding link 50 to slide smoothly in the sliding groove 21, but also prevent the sliding link 50 from having a large deviation in the width direction of the sliding groove 21.

Further, as shown in FIGS. 1 and 6, the link main body portion 51 is disposed on an upper surface, that is, a front surface of the pull main body 20. The upper surface of the pull main body 20 is provided with a guide groove 24 parallel to the sliding groove 21, a rear end of the guide groove 24 penetrates through the pull main body 20 backward, and the link main body portion 51 is accommodated in the guide groove 24 in a manner of being slidable forward and backward. The guide groove 24 is provided to provide better guiding for the forward and backward movement of the sliding link 50 in the sliding groove 21, and can also prevent the sliding link 50 from having a large deviation in the width direction of the sliding groove 21.

Further, in the extensible lock pull of the first embodiment, the position limiting buffer member 40 is fixed on the pull main body 20 by injection molding, which makes the fixation more reliable. In addition, as shown in FIG. 3, a left edge of the position limiting buffer member 40 does not extend to the left beyond a left edge of the pull main body 20, and a right edge of the position limiting buffer member 40 does not exceed to the right beyond a right edge of the pull main body 20. Preferably, as shown in FIG. 6, a front end of the pull main body 20 is provided with a reinforcement connecting hole 25 penetrating vertically, and the reinforcement connecting hole 25 is located between the attachment connecting hole 11 and the attachment opening portion 22, that is, located on a front side of the attachment opening portion 22 opposite to the sliding groove 21. After the position limiting buffer member 40 is injection-molded, a part of the position limiting buffer member 40 is embedded in the reinforcement connecting hole 25, thereby improving the reliability of the fixed connection between the position limiting buffer member 40 and the pull main body 20, and further improving the reliability of holding the sliding link 50 in the sliding groove 21. Further, in the extensible lock pull of the first embodiment, the pull main body 20 is an integral component, and the sliding link 50 formed with the lock head 30, the connecting column portion 52 and the position limiting blade portion 53 is also an integral component. In particular, the pull main body 20 and the sliding link 50 are both zinc alloy castings, and are both made by zinc alloy injection casting.

Extensible Lock Pull of Second Embodiment

As shown in FIG. 7 to FIG. 9, in an extensible lock pull of a second embodiment, the lock head 30 is directly connected to the sliding groove 21, and thus the lock head 30 is assembled in the sliding groove 21. The lock head 30 is a built-in structure with respect to the pull main body 20 and the sliding groove 21. The structure is simple. Although the pull main body 20 needs to be lengthened, the number of parts in the extensible lock pull is reduced, and the cost is reduced. In particular, the built-in structure of the lock head 30 can better prevent the lock head 30 from being separated, deformed, damaged, or the like due to a side force.

Figure 10:
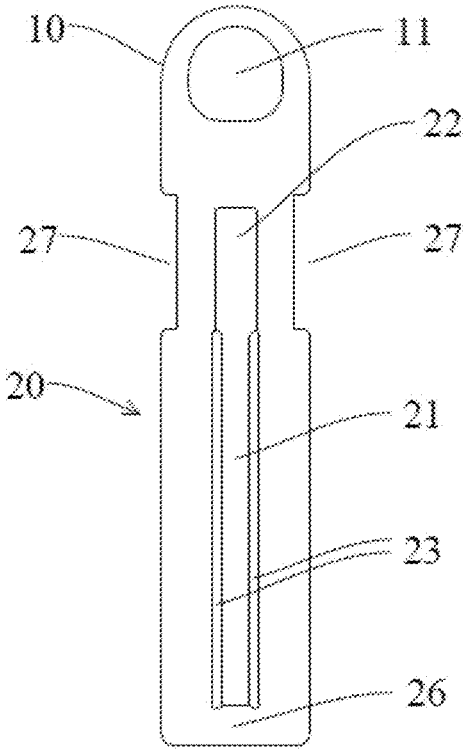
FIG. 10 is a top view of a pull main body in FIG. 7.

As shown in FIGS. 8 and 10, in the extensible lock pull of the second embodiment, the attachment opening portion 22 is disposed in the same manner as in the extensible lock pull of the first embodiment, that is, the pull main body 20 is provided with the attachment opening portion 22 only at a front end of the sliding groove 21 close to the slider connecting portion 10, the pull main body 20 is provided with the blocking end 26 at a rear end of the sliding groove 21, and the front end and the rear end of the sliding groove 21 are blocked by the position limiting buffer member 40 and the blocking end 26, respectively. In a case where the lock head 30 slides forward and backward in the sliding groove 21, when the lock head 30 slides forward to the front end of the sliding groove 21 and abuts against the position limiting buffer member 40, the position limiting buffer member 40 can not only play a buffering role, but also limit the further forward movement of the lock head 30. At this time, a minimum distance exists between the lock head 30 and the slider main body 60. When the lock head 30 slides backward to the rear end of the sliding groove 21 and abuts against the blocking end 26, the blocking end 26 limits the further backward movement of the lock head 30. At this time, a maximum distance exists between the lock head 30 and the slider main body 60.

Figure 11:
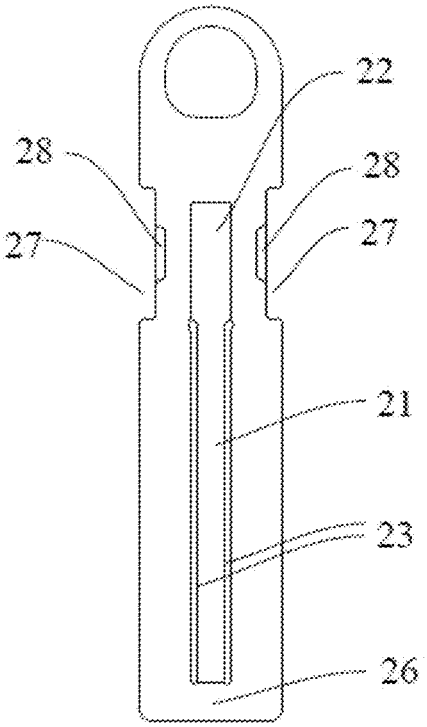
FIG. 11 is a bottom view of the pull main body in FIG. 7.
Figure 14:
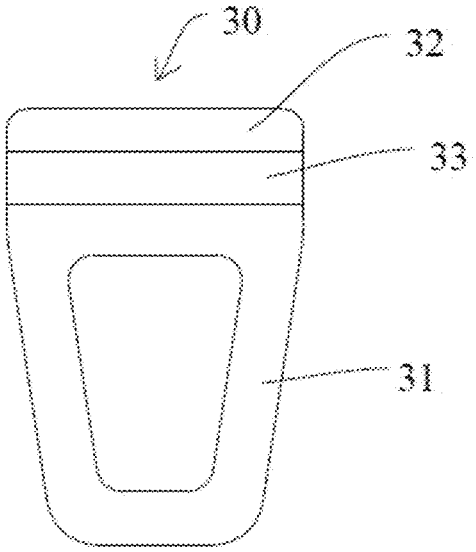
FIG. 14 is a side view of a lock head in FIG. 7.
Figure 15:
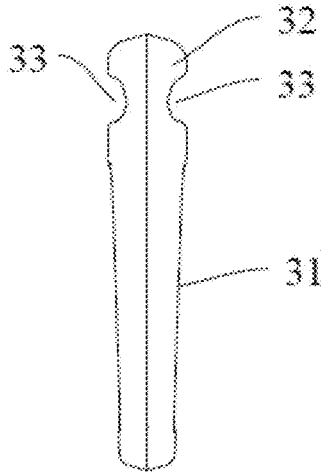
FIG. 15 is a front view of the lock head in FIG. 7.

Further, a preferred structure of the lock head 30 being attached to the sliding groove 21 through the attachment opening portion 22 is as follows. As shown in FIGS. 10 and 11, in the left-right direction, a width of the sliding groove 21 is smaller than a width of the attachment opening portion 22, and thus the pull main body 20 includes sliding support portions 23 on both left and right sides in a width direction of the sliding groove 21. As shown in FIGS. 14 and 15, the lock head 30 includes a lock head main body portion 31 and a lock head connecting portion 32 connected in sequence. The attachment opening portion 22 allows at least one of the lock head main body portion 31 or the lock head connecting portion 32 to pass therethrough, left and right sides of the lock head connecting portion 32 are each provided with a connecting clamping groove 33 parallel to the sliding groove 21, and the connecting clamping groove 33 is preferably a circular arc groove. When the lock head 30 is attached, the lock head main body portion 31 of the lock head 30 is inserted downward into the attachment opening portion 22 until the connecting clamping groove 33 on the lock head connecting portion 32 is aligned with the sliding support portion 23. Then, the lock head 30 is moved backward, and thus the lock head connecting portion 32 is accommodated in the sliding groove 21. Finally, the position limiting buffer member 40 is attached at the attachment opening portion 22, thereby completing the attachment of the lock head 30. After the attachment is completed, the lock head connecting portion 32 is accommodated in the sliding groove 21 in a manner of being movable forward and backward, and the sliding support portions 23 are clamped in the connecting clamping grooves 33 on the left and right sides of the lock head connecting portion 32, thereby reliably holding the lock head 30 in the sliding groove 21.

Figure 12:
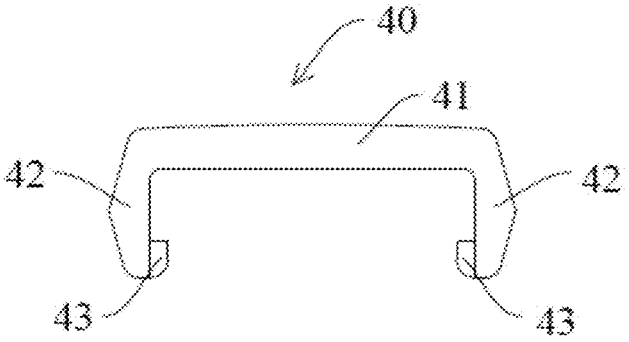
FIG. 12 is a front view of a position limiting buffer member in FIG. 7.
Figure 13:
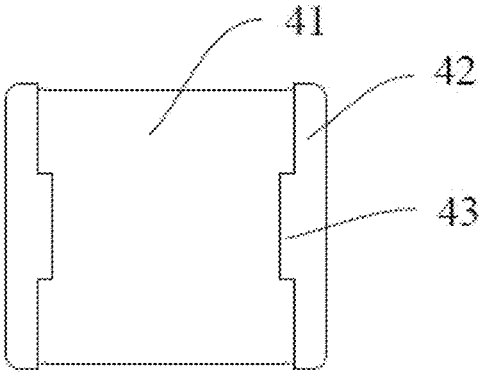
FIG. 13 is a bottom view of the position limiting buffer member in FIG. 7.

Further, in the extensible lock pull of the second embodiment, the position limiting buffer member 40 is first injection-molded and then clamped on the pull main body 20. As shown in FIGS. 12 and 13, the position limiting buffer member 40 after injection molding includes a cover plate portion 41, side wall portions 42 extending downward from left and right sides of the cover plate portion 41 in a thickness direction of the pull main body 20, and anti-separation claws 43 each extending from an inner side of a corresponding one of the side wall portions 42. The anti-separation claw 43 is disposed at an intermediate position of the side wall portion 42 in the front-rear direction, the cover plate portion 41 covers an upper surface (that is, a front surface) of the pull main body 20, the two side wall portions 42 cover a left side surface and a right side surface of the pull main body 20, respectively, and the anti-separation claw 43 is clamped on a lower surface (that is, a back surface) of the pull main body 20, thereby reliably fixing the position limiting buffer member 40 on the pull main body 20 and blocking the attachment opening portion 22. Preferably, as shown in FIGS. 10 and 11, left and right edges of the pull main body 20 are each provided with a positioning clamping groove 27, and the side wall portions 42 of the position limiting buffer member 40 are clamped in the positioning clamping grooves 27 so as to facilitate the attachment of the position limiting buffer member 40. The lower surface of the pull main body 20 is provided with claw accommodating grooves 28 each in communication with the corresponding positioning clamping groove 27, and the anti-separation claws 43 are accommodated in the claw accommodating grooves 28, which reduces the convex foreign matter feeling on a lower surface of the extensible lock pull and improves the comfort of use.

Further, in the extensible lock pull of the second embodiment, the pull main body 20 is an integral component, and the lock head 30 is also an integral component. In particular, the pull main body 20 and the lock head 30 are both zinc alloy castings, and are both made by zinc alloy injection casting. In combination with the built-in structure in which the lock head 30 is directly connected to the sliding groove 21, the pull main body 20 encloses the lock head 30. The pull main body 20 and the lock head 30 are both metal parts and have excellent visual integrity.

Further, in both the extensible lock pull of the first embodiment and the extensible lock pull of the second embodiment, the attachment opening portion 22 is provided at the front end of the sliding groove 21 close to the slider connecting portion 10, that is, the attachment opening portion 22 is provided on a non-pull-out side of the lock head 30 in a length direction of the sliding groove 21. The extensible lock pull is mainly used on a suitcase with an expansion function. When the suitcase is expanded to increase a thickness thereof, the lock head 30 needs to be pulled back along the extending direction of the sliding groove 21. If the attachment opening portion 22 is disposed on a pull-out side (that is, a rear side) of the lock head 30 in the length direction of the sliding groove 21, the lock head 30 will be subjected to tension and damaged, thereby causing the lock head 30 to be separated from the attachment opening portion 22. Therefore, in the present application, the attachment opening portion 22 is provided at the front end of the sliding groove 21 close to the slider connecting portion 10, and thus the lock head 30 can be well prevented from being separated from the attachment opening portion 22.

Figure 17:
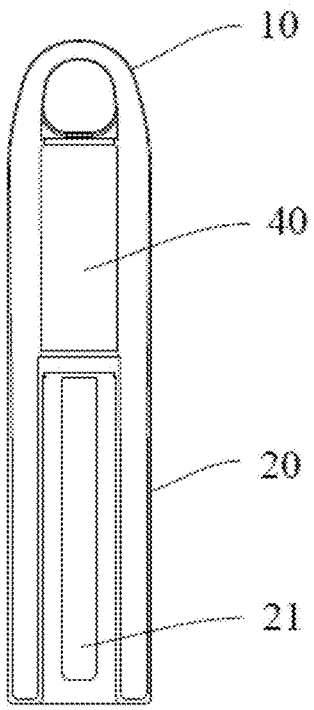
FIG. 17 is a schematic structural diagram of an extensible lock pull of a third embodiment in the present application, in which a lock head and a sliding link are omitted.
Figure 18:
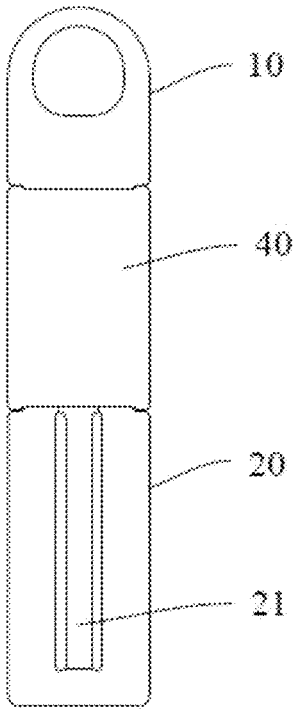
FIG. 18 is a schematic structural diagram of an extensible lock pull of a fourth embodiment in the present application, in which a lock head is omitted.

Extensible Lock Pull of Third Embodiment and Extensible Lock Pull of Fourth Embodiment The position limiting buffer member 40 in the extensible lock pull of the first embodiment is integrally lengthened to obtain an extensible lock pull of a third embodiment shown in FIG. 17. The position limiting buffer member 40 in the extensible lock pull of the second embodiment is integrally lengthened to obtain an extensible lock pull of a fourth embodiment shown in FIG. 18. Therefore, in the extensible lock pull of the third embodiment and the extensible lock pull of the fourth embodiment, a length of the sliding groove 21 is shortened, and a length of the attachment opening portion 22 in the pull main body 20 is increased, thereby increasing the overall length of the position limiting buffer member 40. In this way, the position limiting buffer member 40 has a larger area, especially a larger surface area, and the position limiting buffer member 40 is a plastic part or a rubber part. When the surface area of the position limiting buffer member 40 is increased, a logo can be conveniently and easily printed on a surface of the position limiting buffer member 40, and thus the surface of the position limiting buffer member 40 is provided with a logo or a picture, which can be more eye-catching, thereby enriching the functions of the extensible lock pull.

In addition, in the extensible lock pull of the fourth embodiment, when the position limiting buffer member 40 is integrally lengthened, the positioning clamping groove 27 is also correspondingly lengthened, and thus the area of a clamping portion between the position limiting buffer member 40 and the positioning clamping groove 27 is increased, the fixing reliability of the position limiting buffer member 40 is improved, and the position limiting buffer member 40 is effectively prevented from being separated.

Figure 19:
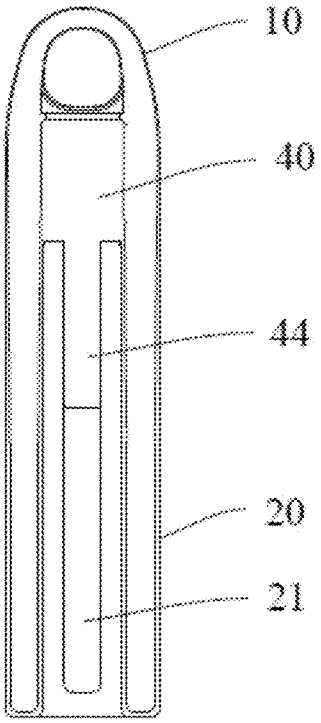
FIG. 19 is a schematic structural diagram of an extensible lock pull of a fifth embodiment in the present application, in which a lock head and a sliding link are omitted.
Figure 20:
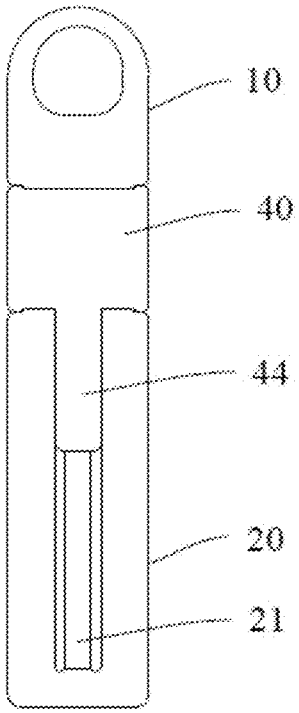
FIG. 20 is a schematic structural diagram of an extensible lock pull of a sixth embodiment in the present application, in which a lock head is omitted.

Extensible Lock Pull of Fifth Embodiment and Extensible Lock Pull of Sixth Embodiment The position limiting buffer member 40 in the extensible lock pull of the first embodiment is partially lengthened to obtain an extensible lock pull of a fifth embodiment shown in FIG. 19. The position limiting buffer member 40 in the extensible lock pull of the second embodiment is partially lengthened to obtain an extensible lock pull of a sixth embodiment shown in FIG. 20. Therefore, in the extensible lock pull of the fifth embodiment and the extensible lock pull of the sixth embodiment, as shown in FIGS. 19 and 20, a rear side of the position limiting buffer member 40 is integrally provided with a buffer member extension portion 44 extending backward, and the buffer member extension portion 44 covers a front portion of the sliding groove 21. By providing the buffer member extension portion 44, a movement range of the lock head 30 can be limited, and thus the movement range of the lock head 30 is reduced, which is suitable for occasions where the lock head 30 does not need to move too much.

As described above, the present invention effectively overcomes various disadvantages in the related art and has high industrial utilization value.

The embodiments described above are merely illustrative of the principles and effects of the present invention and are not intended to limit the present invention. Those skilled in the art can modify or change the embodiments described above without departing from the spirit and scope of the present invention. Therefore, all equivalent modifications or changes made by those skilled in the art without departing from the spirit and technical concept disclosed in the present invention shall still be covered by the claims of the present invention.

As described above, the present invention provides an extensible lock pull, including: a pull main body including: at one end thereof, a slider connecting portion; a lock head; and a position limiting buffer member, in which the pull main body is provided with a sliding groove extending in a length direction thereof, the lock head is movably connected to the sliding groove in an extending direction of the sliding groove, the pull main body is provided with an attachment opening portion in communication with the sliding groove at an end of the sliding groove, the lock head is connected to the sliding groove through the attachment opening portion, the position limiting buffer member is fixed to the pull main body and blocks the attachment opening portion, the pull main body and the lock head are both metal parts, and the position limiting buffer member is a plastic part or a rubber part.

In the extensible lock pull, the lock head is movably connected to the sliding groove in the extending direction of the sliding groove, and thus a position of the lock head in the extending direction of the sliding groove is variable, that is, the position of the lock head in a length direction of the extensible lock pull is variable. In this way, on the one hand, when a slide fastener provided with the extensible lock pull is used for opening and closing a suitcase with an expansion function, a distance between the lock head of the slide fastener and the slider main body is variable, and thus the lock head can be well connected to a combination lock on the suitcase in a non-expansion state and an expansion state of the suitcase, thereby improving the convenience of use. On the other hand, regardless of whether a suitcase has the expansion function, when a slide fastener provided with the extensible lock pull is used for opening and closing the suitcase, a deviation of an actual sewing position of the slide fastener can be well offset by the variable position of the lock head, and thus the lock head can be well connected to a combination lock on the suitcase, thereby improving the convenience of use.

Further, by providing the attachment opening portion, the lock head can be conveniently connected to the sliding groove. After the lock head is attached, the position limiting buffer member is used to block the attachment opening portion so as to prevent the lock head from being separated from the sliding groove, thereby reliably maintaining the slidable connection between the lock head and the sliding groove. In subsequent use, when the lock head slides with respect to the sliding groove, a sliding part in the sliding groove abuts against the position limiting buffer member. The position limiting buffer member is a plastic part or a rubber part and has a certain elasticity, which plays a good buffering role. In addition, the pull main body and the lock head are both metal parts, which effectively improve the structural strength and wear resistance of the pull main body and the lock head, that is, improve the overall structural strength and wear resistance of the extensible lock pull, making the extensible lock pull durable.

In the extensible lock pull of the present application, the lock head may be directly connected to the sliding groove, or the lock head may be indirectly connected to the sliding groove through other components. Two preferred structures are provided below.

Structure 1: The lock head is indirectly connected to the sliding groove through a sliding link. Based on this, the extensible lock pull further includes the sliding link, which is movably assembled in the sliding groove along the extending direction of the sliding groove. The lock head is integrally formed at one end of the sliding link and located outside the pull main body. Another end of the sliding link is attached to the sliding groove through the attachment opening portion, and the sliding link is a metal part. By providing the sliding link, the lock head can be disposed outside the sliding groove, the position of the lock head can be within a required range without lengthening the pull main body, that is, a length of the pull main body can be relatively shortened. In addition, after the lock head is disposed outside the sliding groove, the connection between the lock head and the combination lock is performed outside the pull main body, the pull main body does not interfere with the locking of the lock head, which facilitates the locking operation of the lock head. Meanwhile, the sliding link and the lock head are an integrally formed structure, which is a one-piece metal part with high product structural strength, wear resistance, and durability.

In the above technical solution, a preferred structure of the sliding link being attached to the sliding groove through the attachment opening portion is as follows. Along a width direction of the pull main body, a width of the sliding groove is smaller than a width of the attachment opening portion, and thus the pull main body includes sliding support portions on both sides in a width direction of the sliding groove. The sliding link includes a link main body portion, a connecting column portion, and a position limiting blade portion. The lock head is integrally formed at one end of the link main body portion. The connecting column portion and the position limiting blade portion are integrally formed at another end of the link main body portion in sequence in a thickness direction of the pull main body. The attachment opening portion allows the connecting column portion and the position limiting blade portion to pass therethrough. The connecting column portion is movably accommodated in the sliding groove. The link main body portion and the position limiting blade portion are provided to clamp each of the sliding support portions from two sides thereof in the thickness direction of the pull main body. In this way, the sliding link is securely held in the sliding groove.

A preferred solution of the above technical solution is as follows. The connecting column portion and the sliding groove are in clearance fit, which can not only enable the sliding link to slide smoothly in the sliding groove, but also prevent the sliding link from having a large deviation in the width direction of the sliding groove.

A preferred solution of the above technical solution is as follows. A surface of the pull main body is provided with a guide groove parallel to the sliding groove, and the link main body portion is slidably accommodated in the guide groove. The guide groove is provided to further guide the movement of the sliding link in the sliding groove, so as to further prevent the sliding link from having a large deviation in the width direction of the sliding groove.

Structure 2: The lock head is directly connected to the sliding groove, and thus the lock head is assembled in the sliding groove, that is, the lock head is disposed in the sliding groove. The structure is simple. Although the pull main body needs to be lengthened, the number of parts in the extensible lock pull is reduced, and the cost is reduced.

In the above technical solution, a preferred structure of the lock head being attached to the sliding groove through the attachment opening portion is as follows. Along a width direction of the pull main body, a width of the sliding groove is smaller than a width of the attachment opening portion, and thus the pull main body includes sliding support portions on both sides in a width direction of the sliding groove. The lock head includes a lock head main body portion and a lock head connecting portion which are connected in sequence. The attachment opening portion allows at least one of the lock head main body portion or the lock head connecting portion to pass therethrough. The lock head connecting portion is provided with a connecting clamping groove parallel to the sliding groove. Each of the sliding support portions is clamped in the connecting clamping groove. In this way, the lock head is securely held in the sliding groove.

In the above technical solution, the attachment opening portion is provided at one end of the sliding groove close to the slider connecting portion. The pull main body is provided with the attachment opening portion at only one end of the sliding groove, and another end of the sliding groove is blocked by the own structure of the pull main body. When the sliding link abuts against the position limiting buffer member or when the lock head abuts against the position limiting buffer member, a minimum distance exists between the lock head and the slider main body.

In the extensible lock pull according to the present application, the position limiting buffer member and the pull main body are fixed in various methods.

Method 1: The position limiting buffer member is fixed on the pull main body by injection molding, which makes the fixation more reliable. In addition, the pull main body is provided with a reinforcement connecting hole, and the reinforcement connecting hole is located on a side of the attachment opening portion opposite to the sliding groove. After the position limiting buffer member is injection-molded, a part of the position limiting buffer member is embedded in the reinforcement connecting hole, further improving the reliability of the fixed connection between the position limiting buffer member and the pull main body, thereby improving the reliability of holding the sliding link in the sliding groove.

Method 2: The position limiting buffer member is formed and then clamped on the pull main body. At this time, the position limiting buffer member includes a cover plate portion, side wall portions extending from two sides of the cover plate portion in a thickness direction of the pull main body, and anti-separation claws each extending from an inner side of a corresponding one of the side wall portions. The cover plate portion covers a surface of the pull main body, the side wall portions cover side surfaces of the pull main body, and the anti-separation claws are clamped on a back surface of the pull main body, thereby reliably fixing the position limiting buffer member to the pull main body.

In the extensible lock pull according to the present application, since the position limiting buffer member is a plastic part or a rubber part, a logo can be easily printed on a surface of the position limiting buffer member. A surface of the position limiting buffer member is provided with a logo, and the functions of the extensible lock pull are enriched.

The present application further provides a slider, including a slider main body and the above extensible lock pull, in which the slider connecting portion of the pull main body is connected to the slider main body.

As described above, the extensible lock pull and the slider according to the present invention have the following beneficial effects.

In the extensible lock pull according to the present application, the lock head is movably connected to the sliding groove in the extending direction of the sliding groove, and thus the position of the lock head in the extending direction of the sliding groove is variable, that is, the position of the lock head in the length direction of the extensible lock pull is variable. In this way, on the one hand, when a slide fastener provided with the extensible lock pull is used for opening and closing a suitcase with an expansion function, a distance between the lock head of the slide fastener and the slider main body is variable, and thus the lock head can be well connected to a combination lock on the suitcase in a non-expansion state and an expansion state of the suitcase, thereby improving the convenience of use. On the other hand, regardless of whether a suitcase has the expansion function, when a slide fastener provided with the extensible lock pull is used for opening and closing the suitcase, a deviation of an actual sewing position of the slide fastener can be well offset by the variable position of the lock head, and thus the lock head can be well connected to a combination lock on the suitcase, thereby improving the convenience of use.

Further, by providing the attachment opening portion, the lock head can be conveniently connected to the sliding groove. After the lock head is attached, the position limiting buffer member is used to block the attachment opening portion so as to prevent the lock head from being separated from the sliding groove, thereby reliably maintaining the slidable connection between the lock head and the sliding groove. In subsequent use, when the lock head slides with respect to the sliding groove, the sliding part in the sliding groove abuts against the position limiting buffer member. The position limiting buffer member is a plastic part or a rubber part and has a certain elasticity, which plays a good buffering role. In addition, the pull main body and the lock head are both metal parts, which effectively improve the structural strength and wear resistance of the pull main body and the lock head, that is, improve the overall structural strength and wear resistance of the extensible lock pull, making the extensible lock pull durable.

What is claimed is:

1. An extensible lock pull, comprising:

a pull main body including, at one end thereof, a slider connecting portion;

a lock head; and a position limiting buffer member, wherein the pull main body is provided with a sliding groove extending along a length direction thereof, the lock head is movably connected to the sliding groove along an extending direction of the sliding groove, the pull main body is provided with an attachment opening portion in communication with the sliding groove at an end of the sliding groove, the lock head is connected to the sliding groove through the attachment opening portion, the position limiting buffer member is fixed to the pull main body and blocks the attachment opening portion, the pull main body and the lock head are both metal parts, and the position limiting buffer member is a plastic part or a rubber part.

2. The extensible lock pull according to claim 1, further comprising:

a sliding link, wherein the sliding link is movably assembled in the sliding groove along the extending direction of the sliding groove, the lock head is integrally formed at one end of the sliding link and located outside the pull main body, another end of the sliding link is attached to the sliding groove through the attachment opening portion, and the sliding link is a metal part.

3. The extensible lock pull according to claim 2, wherein along a width direction of the pull main body, a width of the sliding groove is smaller than a width of the attachment opening portion, and thus the pull main body includes sliding support portions on both sides in a width direction of the sliding groove, the sliding link includes a link main body portion, a connecting column portion and a position limiting blade portion, the lock head is integrally formed at one end of the link main body portion, the connecting column portion and the position limiting blade portion are integrally formed at another end of the link main body portion in sequence in a thickness direction of the pull main body, the attachment opening portion allows the connecting column portion and the position limiting blade portion to pass therethrough, the connecting column portion is movably accommodated in the sliding groove, and the link main body portion and the position limiting blade portion are provided to clamp each of the sliding support portions from two sides thereof in the thickness direction of the pull main body.

4. The extensible lock pull according to claim 3, wherein the connecting column portion and the sliding groove are in clearance fit.

5. The extensible lock pull according to claim 3, wherein a surface of the pull main body is provided with a guide groove parallel to the sliding groove, and the link main body portion is slidably accommodated in the guide groove.

6. The extensible lock pull according to claim 1, wherein the lock head is assembled in the sliding groove.

7. The extensible lock pull according to claim 6, wherein along a width direction of the pull main body, a width of the sliding groove is smaller than a width of the attachment opening portion, and thus the pull main body includes sliding support portions on both sides in a width direction of the sliding groove, the lock head includes a lock head main body portion and a lock head connecting portion which are connected in sequence, the attachment opening portion allows at least one of the lock head main body portion or the lock head connecting portion to pass therethrough, the lock head connecting portion is provided with a connecting clamping groove parallel to the sliding groove, and each of the sliding support portions is clamped in the connecting clamping groove.

8. The extensible lock pull according to claim 1, wherein the attachment opening portion is provided at an end of the sliding groove close to the slider connecting portion.

9. The extensible lock pull according to claim 1, wherein the position limiting buffer member is fixed on the pull main body by injection molding.

10. The extensible lock pull according to claim 1, wherein the pull main body is provided with a reinforcement connecting hole, the reinforcement connecting hole is located on a side of the attachment opening portion opposite to the sliding groove, and a part of the position limiting buffer member is embedded in the reinforcement connecting hole.

11. The extensible lock pull according to claim 1, wherein the position limiting buffer member is clamped on the pull main body, the position limiting buffer member includes a cover plate portion, side wall portions extending from two sides of the cover plate portion in a thickness direction of the pull main body, and anti-separation claws each extending from an inner side of a corresponding one of the side wall portions, the cover plate portion covers a surface of the pull main body, the side wall portions cover side surfaces of the pull main body, and the anti-separation claws are clamped on a back surface of the pull main body.

12. The extensible lock pull according to claim 1, wherein a surface of the position limiting buffer member is provided with a logo.

13. A slider, comprising:

a slider main body;

the extensible lock pull according to claim 1, wherein the slider connecting portion of the pull main body is connected to the slider main body.

* * * * *